US009326591B2

(12) United States Patent
Nicoline

(10) Patent No.: US 9,326,591 B2
(45) Date of Patent: May 3, 2016

(54) HAIR BRUSH

(71) Applicant: Paris Presents Incorporated, Gurnee, IL (US)

(72) Inventor: Alyssa Carolyn Nicoline, Chicago, IL (US)

(73) Assignee: Paris Presents Incorporated, Gurnee, IL (US)

( * ) Notice: Subject to any disclaimer, the term of this patent is extended or adjusted under 35 U.S.C. 154(b) by 0 days.

(21) Appl. No.: 14/291,919

(22) Filed: May 30, 2014

(65) Prior Publication Data

US 2015/0342335 A1 Dec. 3, 2015

(51) Int. Cl.
*A46B 9/02* (2006.01)

(52) U.S. Cl.
CPC ..... *A46B 9/023* (2013.01); *A46B 2200/104* (2013.01)

(58) Field of Classification Search
CPC ..... A46B 9/023; A46B 2200/104
USPC ..... 15/159.1, 160, 186, 187; 132/120; D4/127, 130, 132, 134, 136
See application file for complete search history.

(56) References Cited

U.S. PATENT DOCUMENTS

| | | | | | |
|---|---|---|---|---|---|
| 1,172,544 | A | * | 2/1916 | Metzner | 132/120 |
| 2,064,860 | A | * | 12/1936 | Sekine | 15/167.1 |
| D169,131 | S | * | 3/1953 | Fay | D4/136 |
| D188,712 | S | * | 8/1960 | Baumgartner | D4/133 |
| 3,140,499 | A | * | 7/1964 | Du Bois | 15/160 |
| 3,886,617 | A | * | 6/1975 | Labran | A46B 17/06 132/119 |
| 4,030,158 | A | * | 6/1977 | Blair et al. | 15/207.2 |
| D253,321 | S | * | 11/1979 | Saute | D4/136 |
| D253,322 | S | * | 11/1979 | Saute | D4/136 |
| D264,275 | S | * | 5/1982 | Megna | D4/136 |
| 4,527,576 | A | * | 7/1985 | Chou | A45D 24/10 132/123 |
| 6,438,785 | B1 | * | 8/2002 | Smith | 15/160 |
| 7,010,827 | B2 | * | 3/2006 | Kim | 15/186 |
| 2011/0088188 | A1 | * | 4/2011 | Ghodsi | 15/143.1 |
| 2011/0094528 | A1 | * | 4/2011 | Leung | 132/120 |

FOREIGN PATENT DOCUMENTS

| | | | |
|---|---|---|---|
| GB | 117862 | * | 8/1918 |
| GB | 251215 | * | 4/1926 |
| GB | 265359 | * | 2/1927 |

* cited by examiner

*Primary Examiner* — Mark Spisich
(74) *Attorney, Agent, or Firm* — Quarles & Brady LLP

(57) ABSTRACT

Hair brushes are disclosed that include a brush head having a front face, a back face, and a central aperture extending though the brush head from the front face to the back face. The brush head has a length L and a width W. The central aperture has a length ranging from about 0.2 L to about 0.9 L and a width ranging from about 0.2 W to about 0.9 W.

19 Claims, 7 Drawing Sheets

HAIR BRUSH

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Background

The present invention relates generally to a hair brush.

2. Description of the Background

Various hair brushes are known that generally include a handle, a brush head, and bristles for brushing hair. Oftentimes such hair brushes are used to brush wet hair to facilitate the styling and drying of the hair. When so used, a user may also use a hair dryer to apply heat and increased air flow to speed the rate of evaporation of water from the hair. However, many prior art brushes interfere with the application of heat and air flow from the hair dryer, thereby prolonging the drying process.

One answer to the interference caused by these brushes is to add apertures to the brush head that allow air to flow through the brush head. For example, one hair brush allows air blown from a hair dryer to the rear face side of the hair brush to be smoothly guided to through-holes in the hair brush to send the air to the front face side. The hair brush includes divergent projections formed on a rear face of a base section and through-holes are respectively formed in depressions located between the projections. A cushion member of a brush section is fixed to the front face side of the base section of the hair brush, and bristles are embedded in the cushion member. Air blown from the hair dryer to the rear face side of the hair brush is guided by the projections to the depressions located between the projections and enters the through-holes. The air passed through the through-holes passes through the holes in the cushion member and is sent to the front face side of the hair brush.

In another example, a hair brush includes bristles extending from openings extending through a cushion on the base of the hair brush. The openings allow a flow of air from a hand-held hair dryer or blower to reach the hair and scalp during brushing. The brush has a handle, a base connected to the handle, and vents running through the base. Bristles are mounted on a long, narrow, substantially rectangular track. The track is affixed to the base so that the bristles extend from the openings. The openings are wider than the tracks and bristles to allow a flow of air to pass through.

However, such prior art hair brushes are poorly designed to achieve maximal drying effect. For example, some hair brushes incorporating through-holes include dozens of small through-holes to allow air to pass through the brush head. Further, other hair brushes include only a few holes located on the back of the brush head, but a multitude of small holes on the face of the brush head between the bristles. These designs choke the air flow from the hair dryer through the brush head. Other examples of hair brushes include elongate apertures on opposite sides of the brush head face requiring an awkward angle for application of the air stream from a hair dryer.

There is a need, therefore, for hair brushes that maximize the drying effect when used in concert with hair dryers.

SUMMARY OF THE INVENTION

According to one aspect, a hair brush includes a brush head having a front face, a back face, and a central aperture extending though the brush head from the front face to the back face. The brush head has a length L and a width W. The central aperture has a length ranging from about 0.2 L to about 0.9 L and a width ranging from about 0.2 W to about 0.9 W.

According to another aspect, a hair brush includes a brush head having a front face, a back face, and an aperture extending though the brush head from the front face to the back face. The brush head has a length L and a width W. The front face has a surface area ranging from about 9/10 LW to about 1/10 LW, and the aperture has an aperture area ranging from about 1/10 LW to about 9/10 LW.

According to a further aspect, a hair brush includes a brush head having a front face, a back face, an aperture extending though the brush head from the front face to the back face, a plurality of bristles surrounding the aperture, a major axis, and a minor axis. The back face is configured to channel an air stream applied thereto along the minor axis to the aperture. The front face is configured to vent the air stream past the bristles along the minor axis.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

As depicted in FIGS. 1 to 9, a hair brush 10 of the present disclosure generally includes a head 12 and a handle 14. The head 12 and handle 14 may be joined by any means, including frictional interference, adhesives, fasteners, or other means. In one embodiment, a ferrule 16 may be used to help join the handle 14 to the head 12. While not wishing to be bound by theory, it is believed that the ferrule 16 may facilitate joining of dissimilar materials such as a wooden or other natural material handle 14 and a plastic head 12. The ferrule 16 may be made of any suitable material including a natural material, a metal, plastic, and the like.

Figure 2:
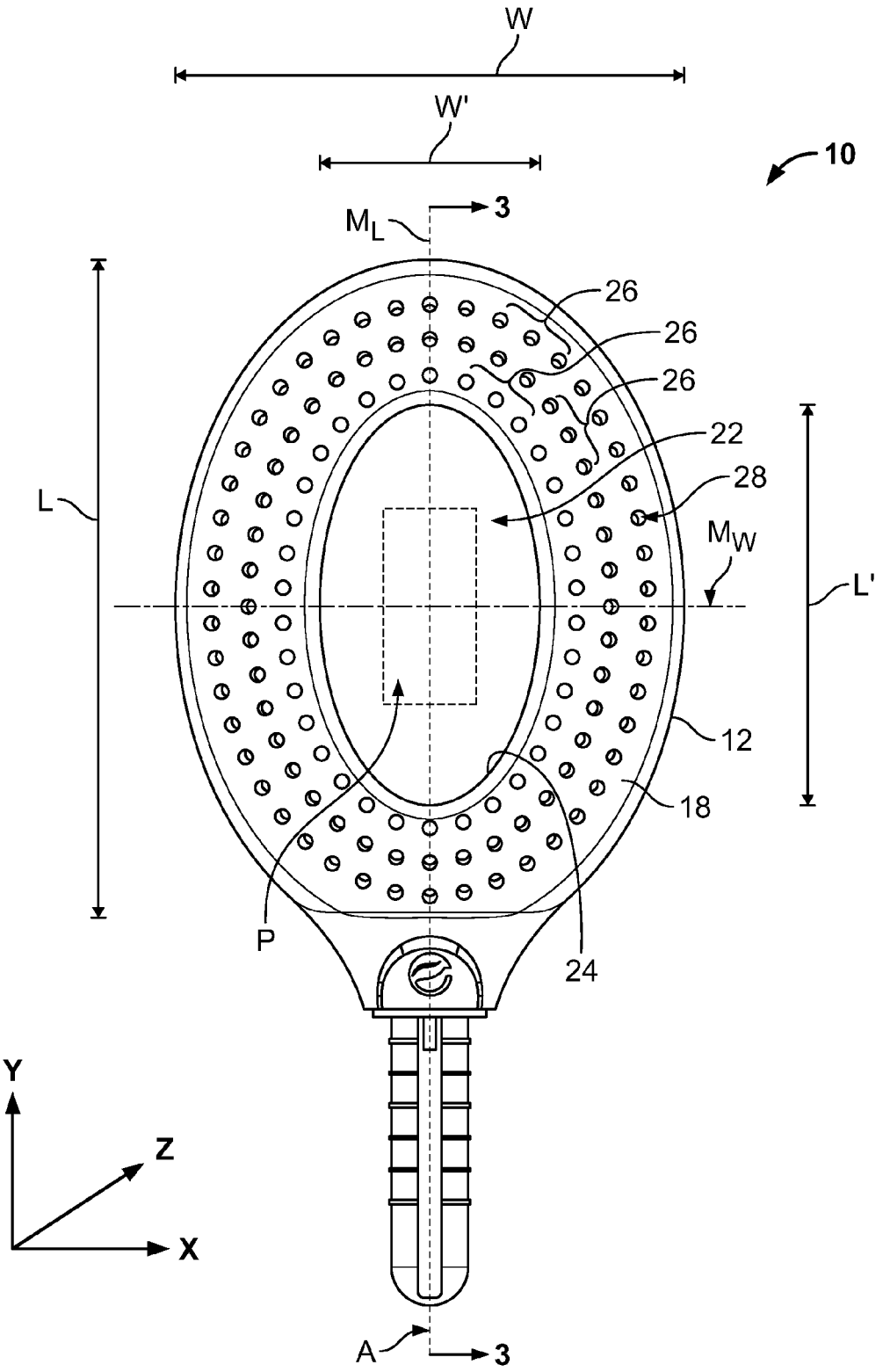
FIG. 2 is a partial, front elevational view of the hair brush of FIG. 1.

The brush head 12 includes a front face 18, a back face 20, and an aperture 22 extending therethrough from the front face to the back face. As seen in FIG. 2, the brush head 12 further includes a major axis $M_L$, which is an extension of the longitudinal axis A of the brush 10 and extends through the center of the handle 14, and a minor axis $M_W$, which is substantially perpendicular to the major axis $M_L$. The major axis $M_L$ and minor axis $M_W$ together define a plane P. The aperture 22 has an aperture area (the smallest restriction area) that is substantially coplanar with plane P.

The brush head 12 further includes a length L, measured along the major axis $M_L$, and a width W measured along minor axis $M_W$. The brush head 12 may have a length L of about (±10%) 14 centimeters, or about 12 centimeters, or about 10 centimeters, or about 8 centimeters, or a length L ranging from about 8 to about 10 centimeters, or about 10 to about 12 centimeters, or about 8 to about 12 centimeters. The brush head 12 may have a width W of about (±10%) 14 centimeters, or about 12 centimeters, or about 10 centimeters, or about 8 centimeters, or about 6 centimeters, or about 5 centimeters, or about 4 centimeters, or a width W ranging from about 4 to about 6 centimeters, or about 6 to about 8 centimeters, or about 8 to about 10 centimeters, or about 10 to about 12 centimeters, or about 6 to about 10 centimeters, or about 8 to about 12 centimeters.

Figure 3:
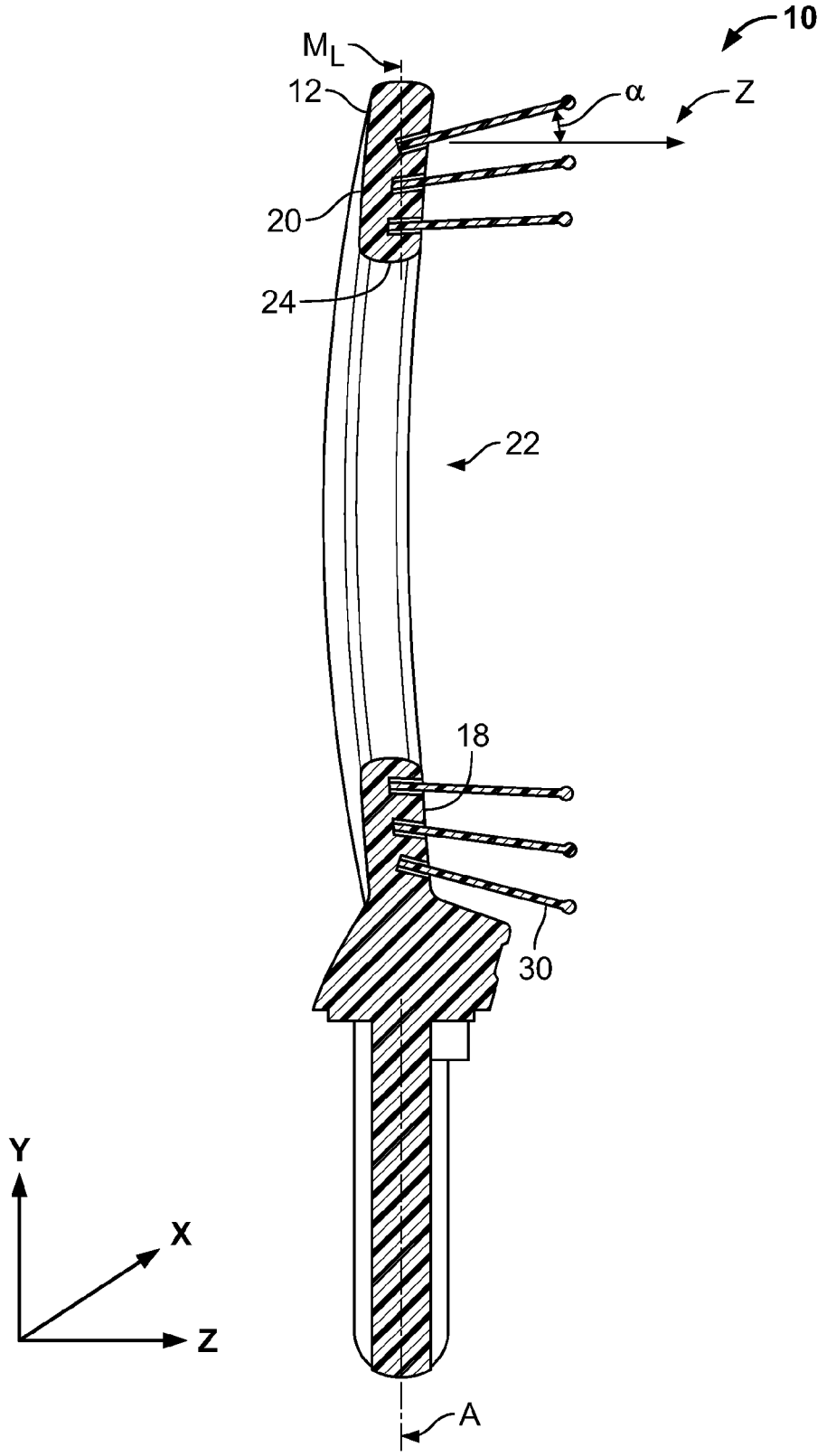
FIG. 3 is cross-sectional view of FIG. 2 taken generally along the lines 3-3 thereof.

The aperture 22 includes a sidewall 24 that has a generally convex surface, as seen in FIG. 3. However, the side wall 24 may have any configuration, including concave or flat, for example, perpendicular or slanted with respect to plane P, or any other desired shape. The aperture 22 may have a length L' measured as the smallest restriction area (sidewall 24 to sidewall across the aperture) along the major axis $M_L$ that may be expressed as a multiple of the length L of the brush head 12 and may be about 0.9 L, or about 0.8 L, or about 0.6 L, or about 0.5 L, or about 0.4 L, or ranging from about 0.2 L to about 0.9 L, or ranging from about 0.4 L to about 0.8 L, or ranging from about 0.4 L to about 0.6 L. Similarly, the aperture 22 may have a width W' measured as the smallest restriction area (sidewall 24 to sidewall across the aperture) along the minor axis $M_W$ that may be expressed as a multiple of the width W of the brush head 12 and may be about 0.8 W, or about 0.7 W, or about 0.6 W, or about 0.5 W, or about 0.4 W, or about 0.3 W, or ranging from about 0.2 W to about 0.9 W, or ranging from about 0.4 W to about 0.8 W, or ranging from about 0.4 W to about 0.6 W. In one embodiment, the aperture 22 may be oriented such that it has a length L' or width W' that is not coaxial with the major axis $M_L$ or the minor axis $M_W$, respectively.

While the brush head 12 depicted in the figures has a generally elliptical outline (see, e.g., FIG. 2), any shape is envisioned for the brush head outline including circular, triangular, rectilinear, symmetrical, asymmetrical, and the like. Similarly, while the aperture 22 depicted in the figures has a generally elliptical outline that resembles that of the brush head 12, any shape for the aperture outline is envisioned including circular, triangular, rectilinear, symmetrical, or asymmetrical, and the like. Further, while the aperture 22 and brush head 12 shown in the figures generally have the same outline shape, they may also have different outline shapes. For example, the brush head 12 may have a circular outline, and the aperture 22 may have an elliptical outline, or the brush head may have a square outline and the aperture may have a circular outline, or the brush head may have a triangular outline and the aperture may have a square outline, or the brush head outline may be star-shaped and that of the aperture may be triangular, or any other combination whether the same or different.

In one embodiment, the front face 18 (or the back face 20) has a surface area of about ¾ LW and an aperture area (the smallest restriction area) of about ¼ LW, or a surface area of about ⅔ LW and an aperture area of about ⅓ LW, or a surface area of about ⅗ LW and an aperture area of about ⅖ LW, or a surface area of about ½ LW and an aperture area of about ½ LW, or a surface area of about ⅖ LW and the aperture area of about ⅗ LW, or a surface area of about ⅓ LW and an aperture area of about ⅔ LW, or a surface area of about ¼ LW and an aperture area of about ¾ LW. In another embodiment, the front face 18 (or the back face 20) has a surface area ranging from about 9/10 LW to about 1/10 LW and an aperture area ranging from about 1/10 LW to about 9/10 LW, or a surface area ranging from about ⅘ LW to about ⅕ LW and an aperture area ranging from about ⅕ LW to about ⅘ LW, or a surface area ranging from about ¾ LW to about ¼ LW and an aperture area ranging from about ¼ LW to about ¾ LW, or a surface area ranging from about ⅔ LW to about ⅓ LW and an aperture area ranging from about ⅓ LW to about ⅔ LW.

The front face 18 of the brush head 12 further includes a plurality of bristle rows 26, each row including a plurality of bristle apertures 28. In one embodiment seen in FIG. 2, the bristle rows 26 substantially surround the aperture 22, and each bristle aperture 28 (and bristle 30 therein) of a single bristle row is approximately equidistant from the sidewall 24 of the aperture. In another embodiment (not shown), bristle rows 26 may form patterns that do not surround the aperture 22, such as small circles, curves, straight lines, wavy lines, or any other configuration.

Figure 4:
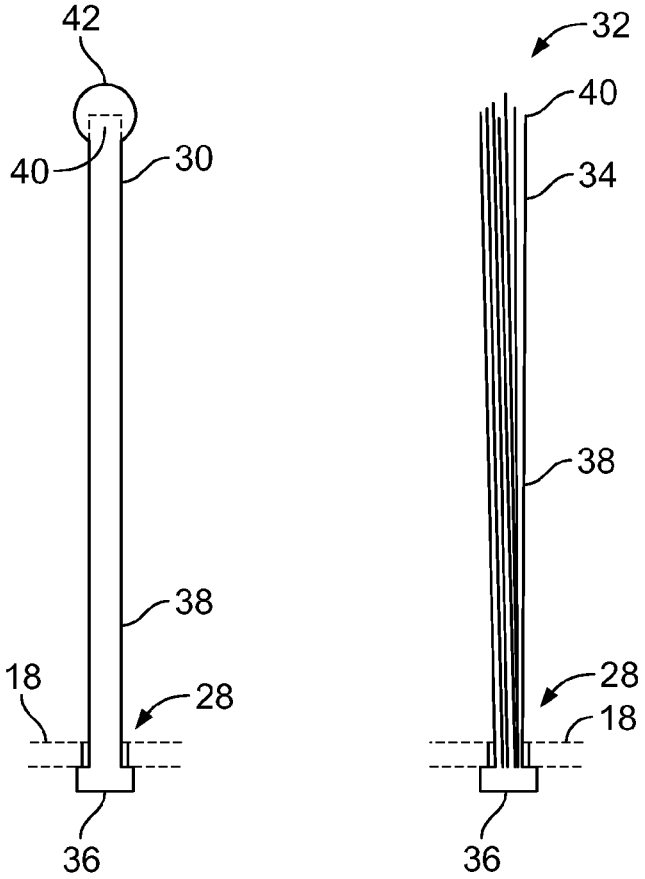
FIG. 4 is a schematic front elevational view of two types of bristles.
Figure 5:
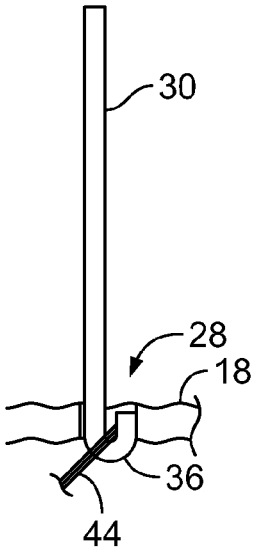
FIG. 5 is a schematic front elevational view of another bristle.

As seen in FIG. 4, a bristle aperture 28 may include a single post-like bristle 30. Alternatively, a bristle aperture 28 may include a bristle cluster 32 that includes a plurality of fine bristles 34 clustered or bunched together and joined together at a common base 36. Bristle clusters 32 may include a number of fine bristles 34 ranging from about 3 to about 10, or about 5 to about 20, or about 10 to about 30 fine bristles, or may include about 10, or about 15, or about 20 fine bristles.

Post-like bristles 30 and fine bristles 34 include a base 36, a shaft 38 extending from the base, and a bristle tip 40. The bristles 30, 34 may be of any length measured from the front face 18 to bristle tip 40, including, for example, about 1.5, or about 2, or about 2.5, or about 3.0, or about 3.5, or about 4.0 centimeters, or shorter or longer. The bristles 30, 34 may be uniform in length or may have different lengths relative to one another. In one embodiment, post-like bristles 30 may be capped with a bristle cap 42. Bristle caps 42 may be spherical or a have another shape, such as ovoid, rectilinear, cylindrical, tear-drop, and the like.

The bristles 30 or bristle clusters 32 emerge from bristle apertures 28 and are attached thereto or anchored therein by any suitable means such as by heat welding, adhering with an adhesive composition, frictional interference, or a snap fit. In one embodiment shown in FIG. 5, a bristle 30 (shown here as a post-type bristle, though bristle clusters 32 may similarly be affixed) may be secured by pinning the bristle base 36 within the brush head 12. Here, the bristle base 36 is folded around a fastener 44 to effectively pin the bristle 30 in place. The fastener 44 may be a mesh, a screen, a wire, a pin, or similar device. The bristles may also be attached by other means known in the art.

As seen in FIGS. 2 and 3, the bristles 30 extend from the front face 18 of the brush head 12 in a direction along the z axis that is generally perpendicular to the longitudinal axis A (and plane P). In one embodiment, the bristles 30 may be angled in a direction away from the aperture 22. For example, the bristles 30 may have an angle $\alpha$ of about 2°, or about 5°, or about 7°, or about 10°, or about 12°, or about 15°, or from about 2° to about 15° from perpendicular relative to the plane P (from the z axis).

Figure 1:
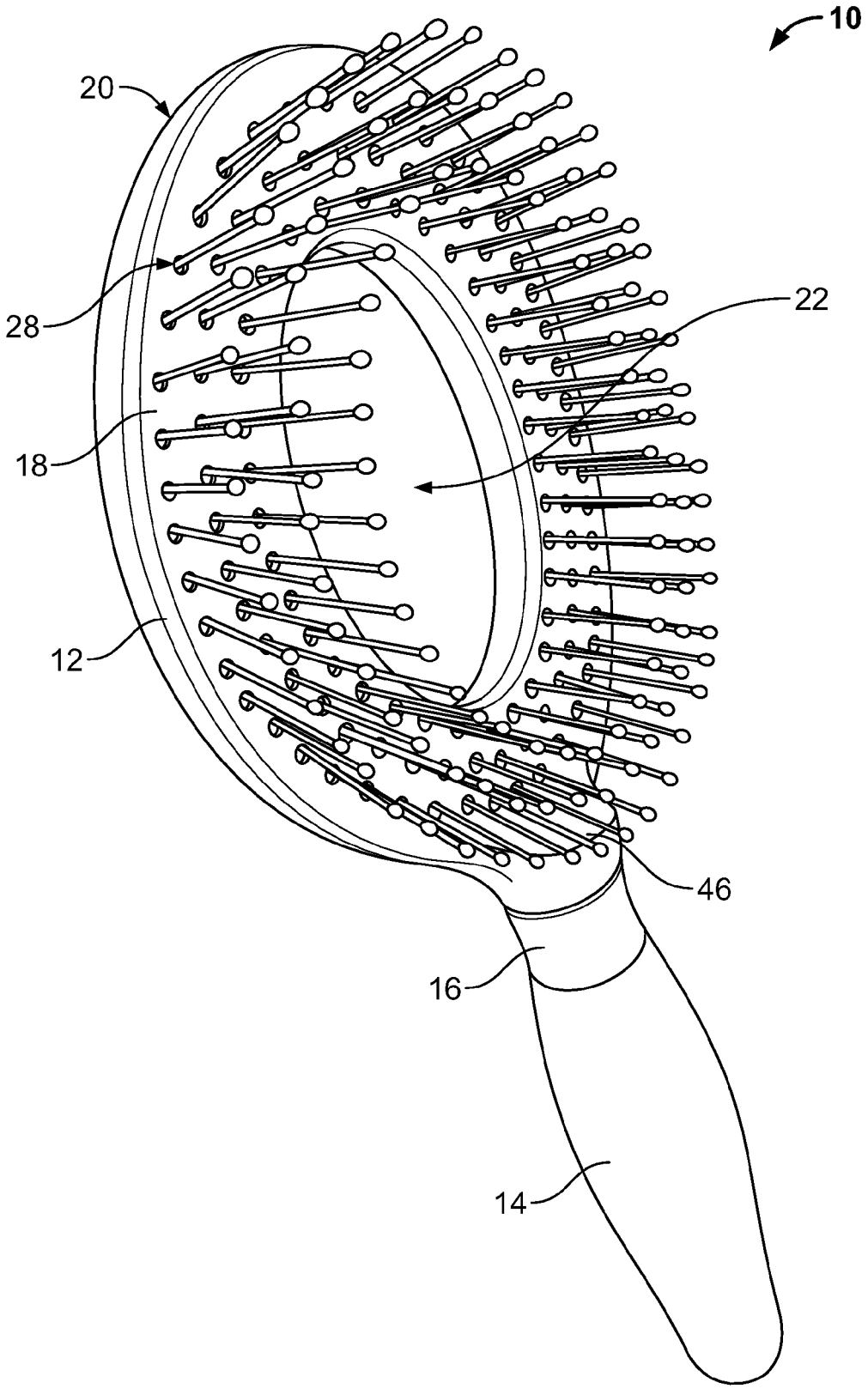
FIG. 1 is a perspective view of a hair brush according to one embodiment.
Figure 6:
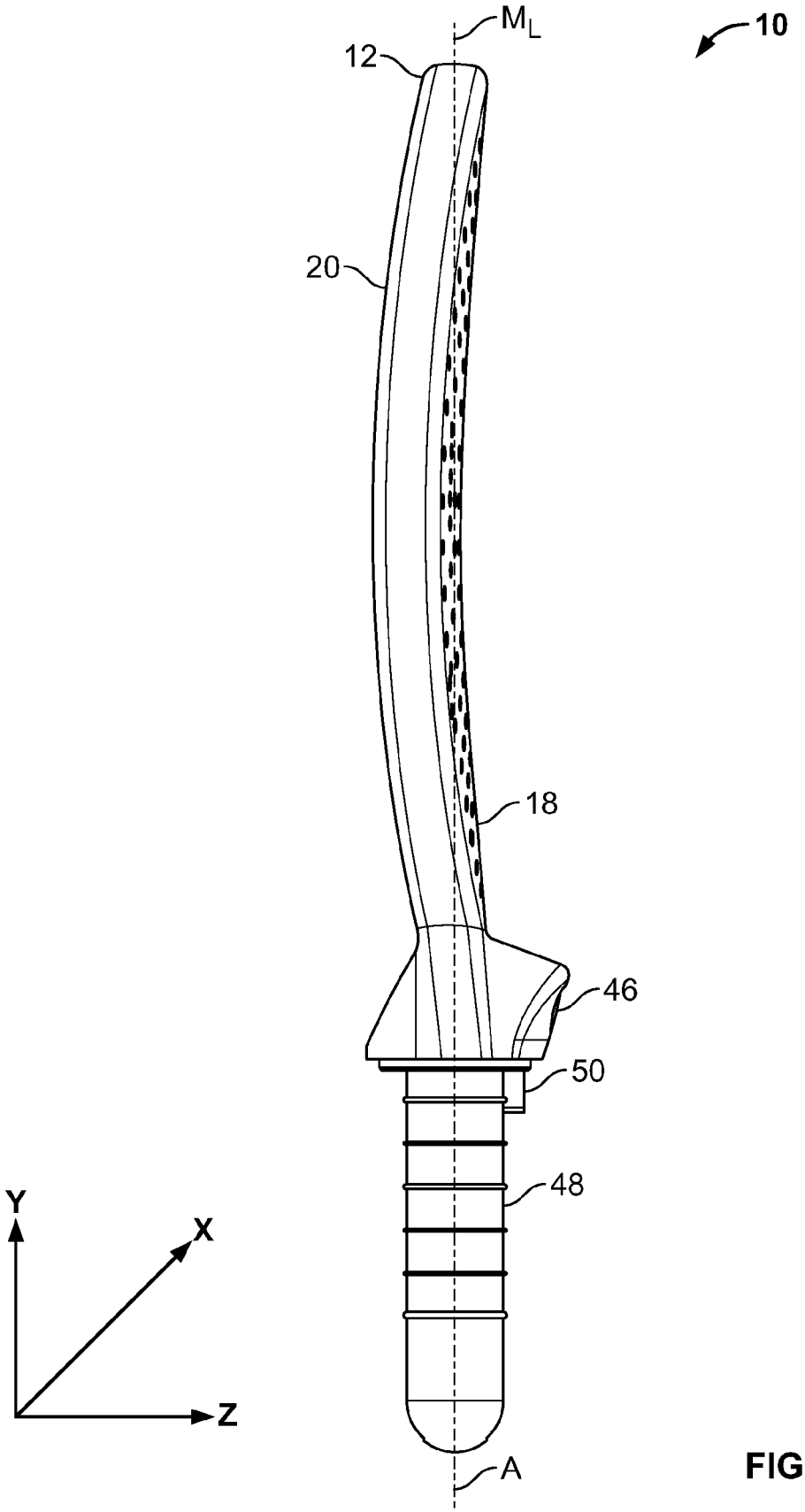
FIG. 6 is a partial, side elevational view of the hair brush of FIG. 2.

The brush head 12 may further include a thumb rest 46 adjacent a handle mount 48 that may extend from the brush head 12 to provide a base for a sturdy connection between the handle 14 and the head (see FIG. 6). The handle mount 48 may be formed integrally with the brush head 12 or may be separately formed and attached to the head. The handle mount 48 may further include a lock and key feature 50 such as a ridge, groove, tooth, pattern, and combinations thereof, or other features that rotationally orient a handle 14 to be connected to the handle mount in a preferred orientation. When assembled, as seen in FIG. 1, the thumb rest 46 is disposed adjacent the handle 14 to provide leverage to a user's thumb when the handle is grasped by a user. The thumb rest 46 contributes to a greater ergonomic and satisfying feel to a user when grasping the brush 10.

Figure 7:
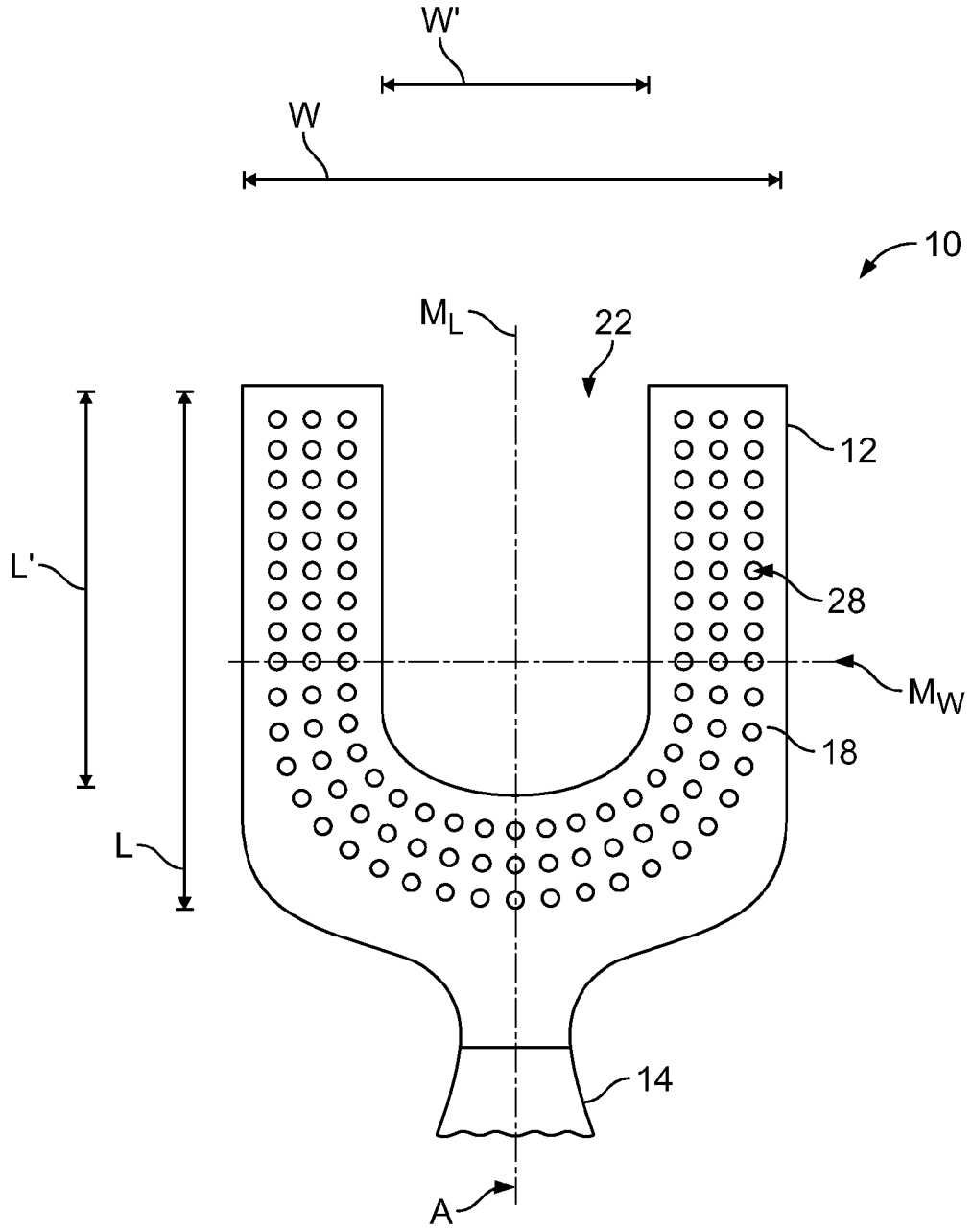
FIG. 7 is a partial, front elevational view of a brush according to another embodiment.

Brushes 10 of the present disclosure are designed to provide improved drying ability. One method to achieve improved drying ability is to incorporate a single, large aperture, like aperture 22 in the brush head 12. The aperture 22 may be centrally disposed as seen in the figures, or may be otherwise disposed. Indeed, in one embodiment, the aperture 22 may be offset to one side to form a U-shaped brush head, as seen in FIG. 7. These configurations of the brush head 12 minimize intervening structure between an applied air stream from, for example, a hair dryer and the hair of a user employing the brush to style hair. Similarly, when an air stream is applied from the opposite side, such that the hair is between the hair dryer and the brush, the large aperture minimizes impeding structure of the brush to allow more air to flow through the hair. Indeed, it is believed that maximizing the size of the aperture 22 minimizes interference caused by the brush 10 when a user is brushing and drying hair at the same time to maximize the drying ability of the brush.

Figure 8:
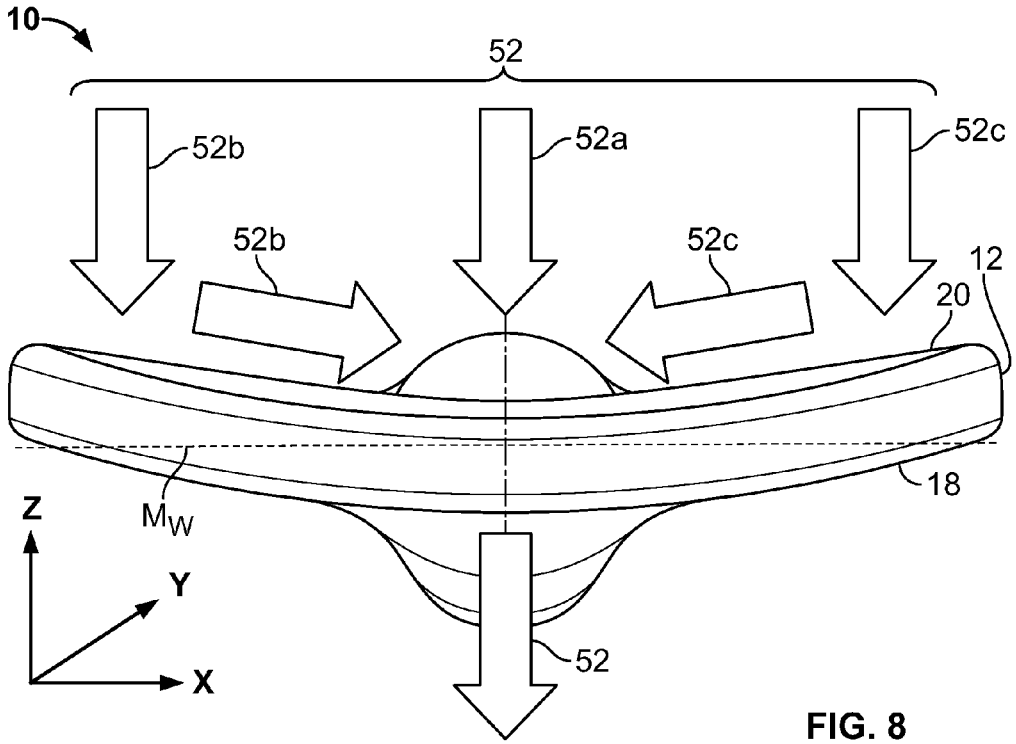
FIG. 8 is a partial, top elevational view of the hair brush of FIG. 2.
Figure 9:
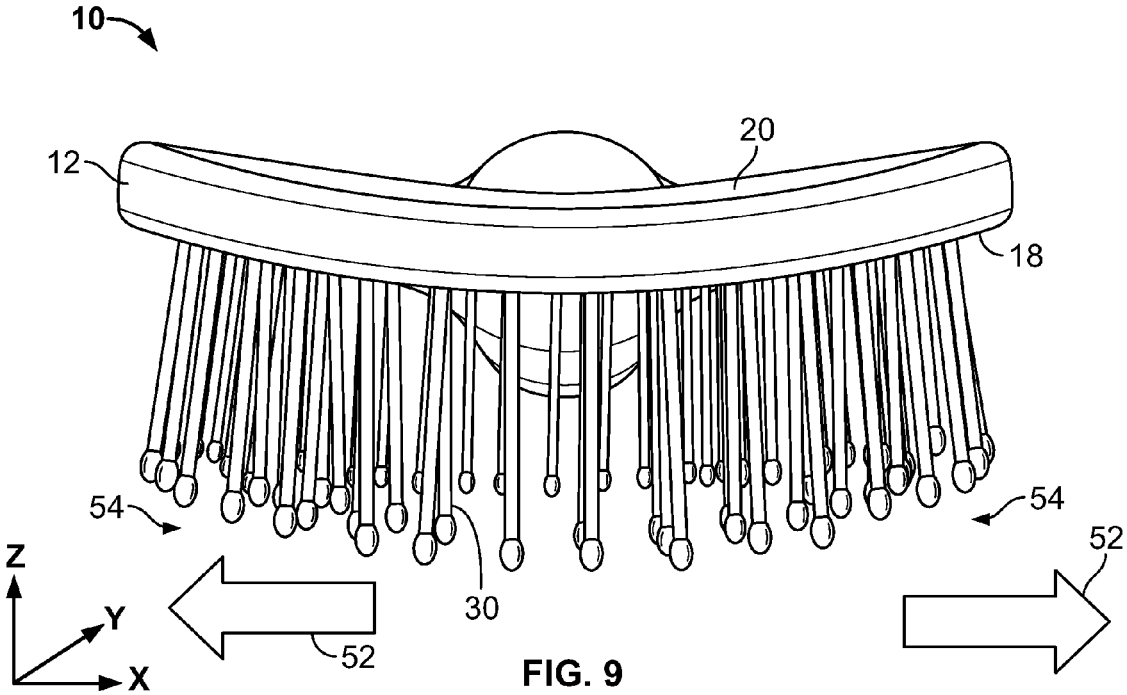
FIG. 9 is a top elevational view of the hair brush of FIG. 1.

Another method for improving drying ability of a brush is illustrated in FIGS. 6, 8, and 9. As seen in FIGS. 6, 8, and 9, the front face 18 has a generally concave configuration along the major axis $M_L$ and a generally convex configuration along the minor axis $M_W$. Conversely, the back face 20 has a generally concave configuration along the minor axis $M_W$ and a generally convex configuration along the major axis $M_L$. These surface configurations of the front face 18 and the back face 20 serve to maximize air drying capacity by improving air flow from an air stream applied to the back face through the aperture 22, as described hereafter.

As seen in FIGS. 8 and 9, when an air stream 52 is applied to the back face 20 of the brush head 12, the central portion thereof 52*a* will pass immediately through the aperture 22. However, portions of the air stream 52*b* and 52*c* on either side of the aperture 22 along the minor axis $M_W$ will meet with the concave surface of the back face 20 and be channeled toward the aperture. In this way, a greater amount of the air stream 52 will pass through the aperture 22 to improve the drying effect of the brush 10. The convex configuration of the front face 18 along the minor axis $M_W$ further contributes to the improved air flow by providing a space 54 between the bristle tips 40 and a user's scalp (not shown) for the air stream 52 to exhaust past the bristles 30 along the minor axis $M_W$.

Hair brushes 10 disclosed herein may be made of any suitable material or combinations of materials. Examples of contemplated materials include polymers, plastics, metals, rubber, silicone, laminated materials, recycled materials, natural and/or eco-friendly materials, biodegradable materials, and combinations thereof. In one embodiment, a contemplated hair brush 10 may incorporate a light-weight, eco-friendly bamboo handle 14, and a plastic brush head 12 into which plastic bristles 30 or bristle clusters 32 are affixed.

In another embodiment, the hair brushes 10 disclosed herein may vary in size, for example, the hair brushes may be sized for an adult or for a child. In one embodiment, a child's hair brush 10 may be approximately about ¾ scale, or about ½ scale, or about ¼ scale of an adult-sized brush. "Adult-sized" brushes 10 may be about 20 to about 25 centimeters in length.

EXAMPLE

An exemplary hair brush of the present disclosure was tested relative to a commercially available hair brush to compare drying speeds, as described below.

Materials and Methods

Tresses of virgin, European medium brown hair, eight inches in length were first weighed at a dry weight. The tresses were then wetted for 30 seconds with warm tap water (37° C.). The wetted tresses were briefly combed to detangle the tresses and reweighed. The tresses were then dried with a commercial drier on a low setting and positioned 30 centimeters from the tresses. Air temperature at the position of the tresses was monitored to ensure constant drying heat (±5° C.) from one test to the next.

The experiment was timed, and the time was recorded when the tresses attained a mass that was +20% of original (dry) mass. Five replicates were run for each sample. During drying, the test brush was run down the tresses while being applied from the opposite side of the incoming hot air. The tresses were constantly stroked during drying. Drying of the tresses was recorded during the process every 15 seconds, and the test was concluded when the tresses were touch dry, which corresponds to a residual water content of +20-25% of dry weight of the tresses. At this point, a consumer would typically stop the drying to proceed to styling.

Results

Weight loss of tresses during the drying process using either the sample brush or control brush was calculated as follows: average over the five tresses of $(W_i-W_t)/(W_i-D_i)$, where $W_i$ is the wetted initial weight, $W_t$ is the weight at the specific time, and $D_i$ is the dry initial weight. Statistical analysis of the results showed the differences in drying times to be significant to a probability of error of less than 10%.

Table No. 1 below indicates the drying time of the tresses in seconds for each brush.

TABLE NO. 1

Drying time.

| Brush | Time (sec.) | Percent decrease in time compared to Conair |
|---|---|---|
| O brush | 56 | 40 |
| Control (CONAIR Ceramic Wooden Boar Cushion Brush) | 94 | — |

As can be seen from Table No. 1, the exemplary brush of the present disclosure dried the tresses at least 40% faster than the control brush.

INDUSTRIAL APPLICABILITY

The hair brushes described herein advantageously improve hair drying.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved. All patents and publications are incorporated by reference.

I claim:

1. A hair brush, comprising:

an oval shaped brush head comprising a front face, a back face, and a central aperture extending though the brush head from the front face to the back face, wherein the front face has a substantially concave configuration along a major axis and a substantially convex configuration along a minor axis, wherein the brush head has a length L that ranges from about 8 centimeters to about 14 centimeters, and a width W that ranges from about 4 centimeters to about 14 centimeters, and wherein the central aperture is oval shaped and has a length ranging from about 0.2 L to about 0.9 L and a width ranging from about 0.2 W to about 0.9 W.

2. The hair brush of claim 1, wherein the length L ranges from about 8 centimeters to about 12 centimeters.

3. The hair brush of claim 1, wherein the width W ranges from about 6 centimeters to about 10 centimeters.

4. The hair brush of claim 1 further comprising a handle extending from a first end of the brush head.

5. The hair brush of claim 4, wherein the handle is comprised of a natural material.

6. The hair brush of claim 5, wherein the natural material comprises bamboo.

7. The hair brush of claim 4, wherein the brush head further comprises a thumb rest adjacent the handle.

8. A hair brush, comprising:

an oval shaped brush head comprising a front face, a back face, and an aperture extending though the brush head from the front face to the back face;

a handle extending from a first end of the brush head, and a plurality of bristles disposed on the front face, wherein the aperture is substantially centrally disposed and has a similar shape to the brush head, wherein the front face has a substantially concave configuration along a major axis, and a substantially convex configuration along a minor axis, wherein the brush head has a length L and a width W, and wherein the front face has a surface area ranging from about 9/10 LW to about 1/10 LW and the aperture has an aperture area ranging from about 1/10 LW to about 9/10 LW.

9. The hair brush of claim 8, wherein the plurality of bristles are disposed along a bristle row.

10. The hair brush of claim 9, wherein the bristle row substantially surrounds the aperture.

11. The hair brush of claim 9, wherein the bristle row is a first bristle row and the front face further comprises a second bristle row.

12. The hair brush of claim 11, wherein each of the bristles of the respective bristle rows are equidistant from a sidewall of the aperture.

13. The hair brush of claim 11, wherein the bristles comprise at least one of a post-type bristle or a cluster bristle.

14. The hair brush of claim 8, wherein the plurality of bristles is attached to the brush head by at least one of heat welding, adhering, frictional interference, a snap fit, a mesh, a screen, a wire, or a pin.

15. A hair brush, comprising:

an oval shaped brush head comprising a front face, a back face, an aperture extending though the brush head from the front face to the back face, a plurality of bristles surrounding the aperture, a major axis, and a minor axis, wherein the plurality of bristles are disposed along the front face, wherein the aperture is substantially centrally disposed and has a similar shape to the brush head, wherein the front face has a substantially concave configuration along the major axis and a substantially convex configuration along the minor axis, wherein the back face is configured to channel an air stream applied thereto along the minor axis to the aperture, and wherein the front face is configured to vent the air stream past the bristles along the minor axis.

16. The hair brush of claim 15, wherein the back face has a concave configuration along the minor axis.

17. The hair brush of claim 15, wherein the major axis and the minor axis describe a plane.

18. The hair brush of claim 17, wherein the bristles extend generally perpendicularly from the plane.

19. The hair brush of claim 18, wherein the bristles are angled in a direction away from the aperture by about 2° to about 15° from perpendicular.

* * * * *